US006910510B2

(12) United States Patent
Gale et al.

(10) Patent No.: US 6,910,510 B2
(45) Date of Patent: Jun. 28, 2005

(54) PORTABLE, CRYOGENIC GAS DELIVERY APPARATUS

(75) Inventors: Peter P. Gale, Bethlehem, PA (US); Michael Thomas Delich, Palmerton, PA (US)

(73) Assignee: Precision Medical, Inc., Northampton, PA (US)

( * ) Notice: Subject to any disclaimer, the term of this patent is extended or adjusted under 35 U.S.C. 154(b) by 0 days.

(21) Appl. No.: 10/620,530

(22) Filed: Jul. 16, 2003

(65) Prior Publication Data

US 2005/0011583 A1 Jan. 20, 2005

(51) Int. Cl.[7] ..... F17C 7/02

(52) U.S. Cl. ..... 141/82; 141/2; 141/5; 141/11; 141/18; 141/98; 82/50.2; 82/39.3; 128/201.21; 128/204.17

(58) Field of Search ..... 141/5, 7, 11, 18, 141/37, 46, 51, 82, 98, 2; 62/48.1, 50.2, 383; 128/201.21, 204.17, 204.26, DIG. 27

(56) References Cited

U.S. PATENT DOCUMENTS

| | | | | |
|---|---|---|---|---|
| 1,459,158 A | | 6/1923 | Lisse | |
| 1,472,117 A | | 10/1923 | Drager | |
| 2,158,458 A | | 5/1939 | Mathis et al. | 219/38 |
| 2,423,631 A | | 7/1947 | Akerman et al. | 62/1 |
| 2,501,419 A | | 3/1950 | St. Clair | 62/1 |
| 2,502,588 A | | 4/1950 | Preston et al. | 62/1 |
| 2,515,835 A | | 7/1950 | Preston | 62/1 |
| 2,934,910 A | | 5/1960 | Tayler | 62/50 |
| 3,548,856 A | | 12/1970 | Vant | 137/210 |
| 4,091,634 A | | 5/1978 | Shepherd | 62/45 |
| 4,211,086 A | * | 7/1980 | Leonard et al. | 62/48.1 |
| 4,313,306 A | | 2/1982 | Torre | 62/51 |
| 4,608,831 A | | 9/1986 | Gustafson | 62/55 |
| 5,411,374 A | * | 5/1995 | Gram | 417/53 |
| 6,394,088 B1 | * | 5/2002 | Frye et al. | 128/204.26 |

FOREIGN PATENT DOCUMENTS

| | | |
|---|---|---|
| JP | 2-57797 | 2/1990 |
| SU | 1469238 A1 | 3/1989 |

* cited by examiner

*Primary Examiner*—Gregory L. Huson
*Assistant Examiner*—Peter deVore
(74) *Attorney, Agent, or Firm*—Fish & Richardson, P.C.

(57) ABSTRACT

A portable, cryogenic gas delivery apparatus includes a chamber which contains cryogenic material, such as oxygen, in both liquid and gas phases. A probe is mounted to move relative to the chamber in response to variations in pressure in the gas phase within the chamber. The probe has one part positioned within the chamber so that it is exposed to the pressure and temperature of the gas within the chamber and a second part located outside the chamber. The probe thus introduces heat from the ambient into the chamber. The probe preferably moves relative to the chamber in response to variations in pressure, moving away from the chamber to reduce the amount of thermal energy introduced into the chamber and toward the chamber to increase the amount of thermal energy introduced into the chamber. The apparatus includes a conserver which receives gas evaporating from the chamber and delivers it in efficient pulses to the end user in response to the user's inhalation.

49 Claims, 5 Drawing Sheets

PORTABLE, CRYOGENIC GAS DELIVERY APPARATUS

BACKGROUND TO THE INVENTION

Patients often wish to remain mobile or ambulatory while also receiving oxygen. This generally requires the oxygen delivery apparatus to be portable. To be portable, the oxygen or gas delivery apparatus preferably has to be compact and relatively lightweight. This is especially important since many patients needing oxygen are already frail or of limited physical capacity. One approach to such portability has been to store the oxygen or gas under pressure in gas cylinders, and such gas cylinders are equipped with pressure regulators, flow meters, and other apparatus for delivering the desired flow of oxygen to the patient. The need to make such high pressure gas cylinders smaller for ambulatory uses has meant a corresponding increase in the pressures applied to gases in such cylinders. The transportation and use of such high-pressure devices may require special handling in ambulatory or home-based settings.

Furthermore, even when gas has been compressed to 2,000 PSI, the compact cylinders need to be changed relatively frequently. This reduces the "range" that a patient may have with this high-pressure gas cylinder type of apparatus.

To lengthen the effective life of an oxygen delivery apparatus, manufacturers have resorted to so-called "cryogenic systems" or "liquid systems." These systems make use of liquid oxygen as opposed to merely using pressurized oxygen in the gas phase. Liquid oxygen is generally 860 times more compact than typical pressurized gas. Cryogenic systems generally involve a thermal flask or cryogenic chamber. Such flasks or chambers include an inner vessel containing liquid oxygen. This inner vessel is surrounded by an outer casing and, importantly, between the outer casing and inner vessel, a vacuum is generally established to improve the insulative properties of the thermal flask.

In operation, cryogenic systems of the current art usually draw off a predetermined quantity of liquid oxygen which is then sent through a series of warming coils. As the liquid oxygen travels through the warning coils, it changes phase and evaporates into oxygen gas. The warming coils thus are often critical to transforming the liquid oxygen drawn from the flask into oxygen gas at an appropriate temperature to be inhaled by the patient.

Unfortunately, the systems of the current art suffer from various drawbacks and disadvantages. For example, the warming coils used in current systems have various difficulties, complexities, and other shortcomings. Coils often are bulky. Warming-coil-type apparatus may, under certain circumstances, be mishandled or otherwise operated imprudently with the result that liquid oxygen from inside the container is depleted too quickly or escapes inadvertently to potentially "burn" the users.

SUMMARY OF THE INVENTION

According to one aspect of the invention, a cryogenic gas delivery apparatus includes a chamber which is sufficiently insulated to maintain a cryogenic material as both a liquid and its corresponding gas. At least one probe has a first part positioned so that it is exposed to the pressure and temperature of the cryogenic material contained therein. A second part of the probe is located so that it is exposed to ambient temperature. In this way, the probe introduces heat from the ambient into the chamber. The probe is mounted to move relative to the chamber in response to variations in the pressure of the gas in the chamber. The movement of the probe correspondingly varies the amount of thermal energy which is introduced in the chamber. A passage leads from the gas in the chamber to deliver the gas to a user.

In another version of the invention, the foregoing gas delivery apparatus makes use of a conserver which receives the gas escaping from the chamber through the passage described above. The conserver, in turn, has a sensing system which is operatively connected to discharge gas at appropriate times through an outlet. In particular, the operative connection of the sensing system delivers gas when the sensing system senses inhalation by the user.

In still another version of the present invention, the system includes a fill system which is configured so that the chamber is only partially filled with cryogenic liquid. The remainder of the container is filled with the volume of the corresponding pressurized gas, forming a head space above the volume of the liquid phase.

According to another aspect of the present invention, a portable, liquid oxygen system delivers oxygen gas to a user. The portable liquid oxygen system includes a container for holding liquid oxygen and oxygen gas and an associated fill system, as well as a delivery system connected to the volume of oxygen gas in the container. The portable liquid oxygen system has a regulator, which operates on thermo-pneumatic principles in the sense that it varies the amount of thermal energy introduced into the container of the system in response to corresponding variations in the pressure of the gas volume within the container. The regulator includes a detection mechanism and a thermal transfer mechanism. The detection mechanism detects variations in the pressure of the volume of the oxygen gas, while the thermal transfer mechanism increases the evaporation rate of the liquid oxygen in the container in response to the detection of a predetermined drop in pressure, and decreases the evaporation rate in response to detecting an increase in pressure. As such, the regulator regulates the pressure of the volume of the oxygen gas and keeps it within a baseline pressure range.

DETAILED DESCRIPTION OF THE PREFERRED EMBODIMENTS

Figure 1:
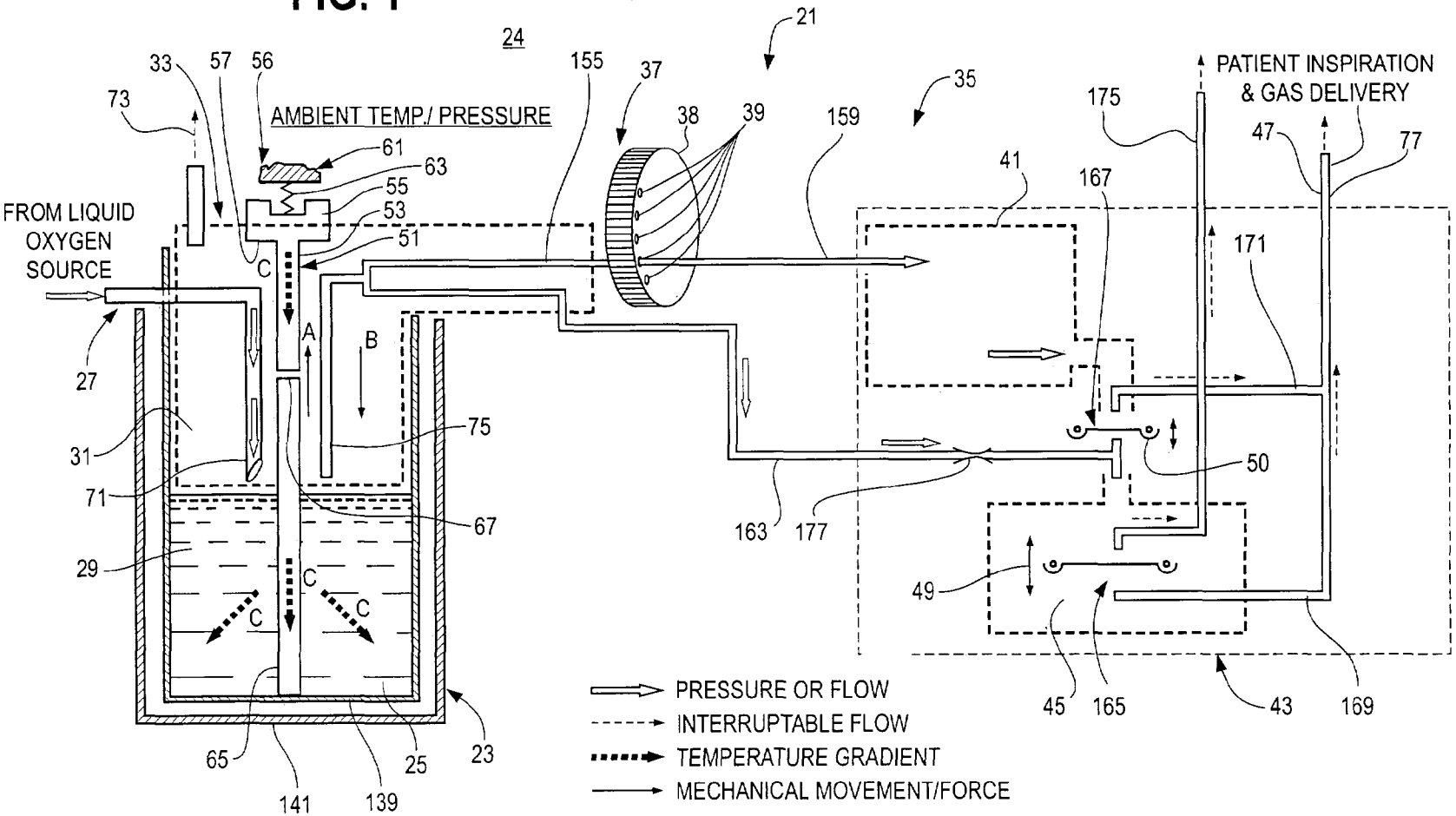
FIG. 1 is a schematic of a cryogenic gas delivery apparatus according to one aspect of the present invention.

Referring now to the drawings, a cryogenic gas delivery apparatus, preferably in the form of a portable, liquid oxygen system 21, is shown schematically in FIG. 1. Liquid oxygen system 21 includes a vessel for holding material in a cryogenic state, preferably in the form of an insulated container 23 with a chamber 25 located therein. Chamber 25 is sufficiently insulated from the temperature and pressure of the ambient to hold oxygen in both the liquid and gaseous phases at temperatures below ambient temperature and pressures above ambient pressure. System 21 is "charged" with oxygen by means of fill system 23. Fill system 27 includes one or more structures, components, or passages suitable for filling container 23 only partly with liquid oxygen. In this manner, chamber 25 contains not only a volume 29 of liquid oxygen therein, but also a volume 31 of pressurized oxygen gas located adjacent the volume of liquid oxygen.

Liquid oxygen system 21 preferably includes a delivery system 35. Delivery system 35 includes one or more structures, components, or passages suitable for carrying gaseous oxygen from container 23 to the user. Preferably, delivery system 35 includes a flow-rate controller 37 and a conserver 43 in communication with the controller 37. Flow-rate controller 37 receives gaseous oxygen from container 23 and restricts the flow therefrom by passing the gaseous oxygen through a user-selected one of a series of variably sized orifices 39. The gaseous oxygen to be delivered to the user exits flow rate controller 37 and enters conserver 43.

A pressure regulator 33 has been devised for liquid oxygen system 21 to regulate the pressure of the volume of pressurized oxygen 31 to remain within a selected base-line pressure range. The regulator 33 preferably operates on "thermo-pneumatic" principles, because, as detailed herein, it regulates the pressure of gas volume 31 by varying the amount of thermal energy introduced into chamber 25 in response to corresponding variations in the pressure of gas volume 31 in the chamber 25. The regulator 33 maintains suitable pressures in gas volume 31 sufficient to supply delivery system 35 with oxygen to satisfy the user's breathing needs in a variety of sedentary and active circumstances.

Conserver 43 prolongs the "range" of the resulting portable, liquid oxygen system 21, thereby increasing the freedom of those required to move about with the assistance of oxygen. Conserver 43 can be of any suitable type, including electronic, pneumatic, or a hybrid. In the illustrated embodiment, conserver 43 is preferably of the purely pneumatic-type. Gaseous oxygen to be delivered to the user enters conserver 43 and fills reservoir 41. Conserver 43 includes a sensing system 45 with suitable structures, including two diaphragms 49, 50, for opening reservoir 41 in response to inhalation by the patient. Oxygen is delivered from reservoir 41 to a patient through gas line 47 in response to the patient inhaling or inspiring.

Figure 2:
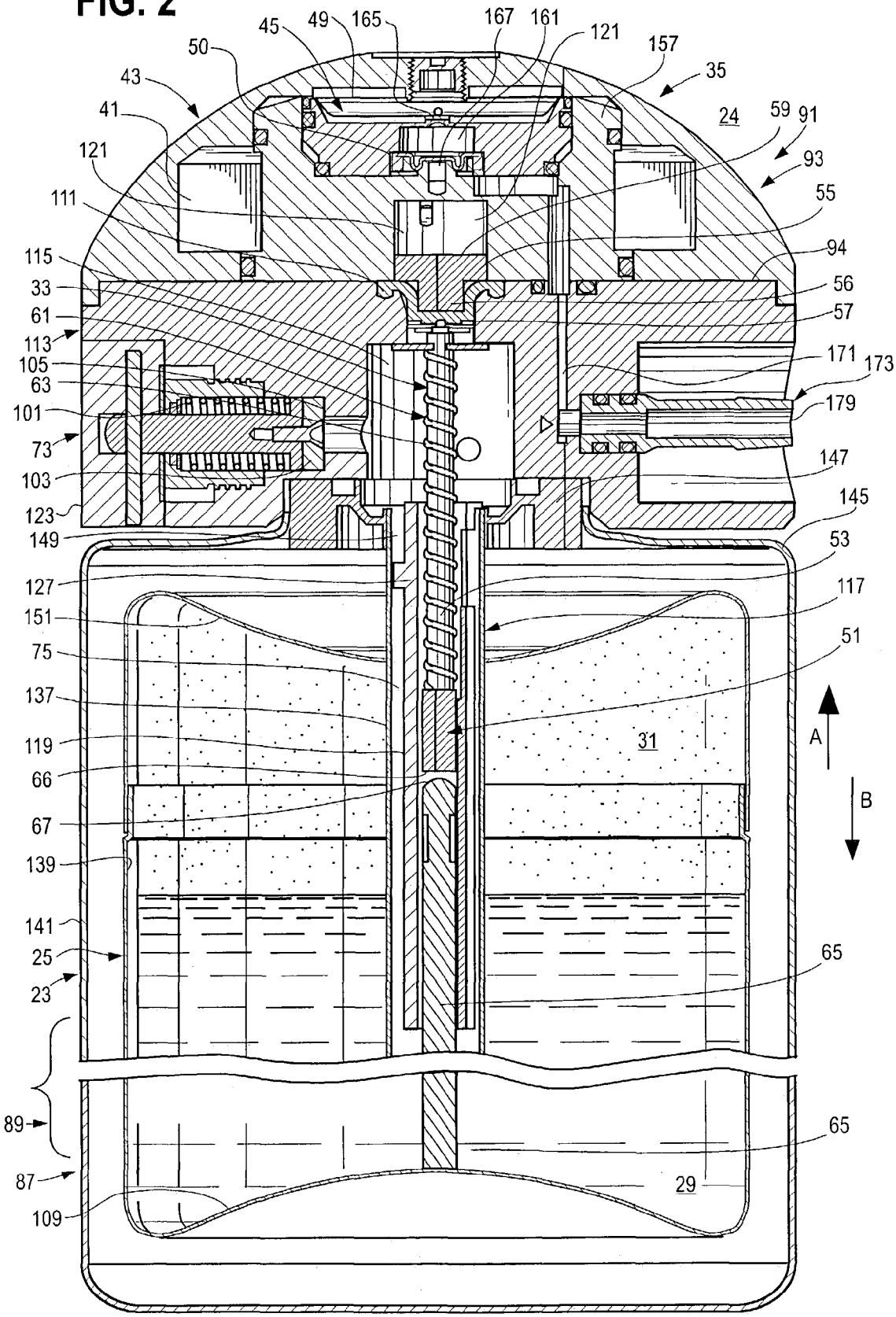
FIG. 2 is a cross-sectional, elevation view of one preferred embodiment of the cryogenic gas delivery apparatus of FIG. 1.
Figure 3:
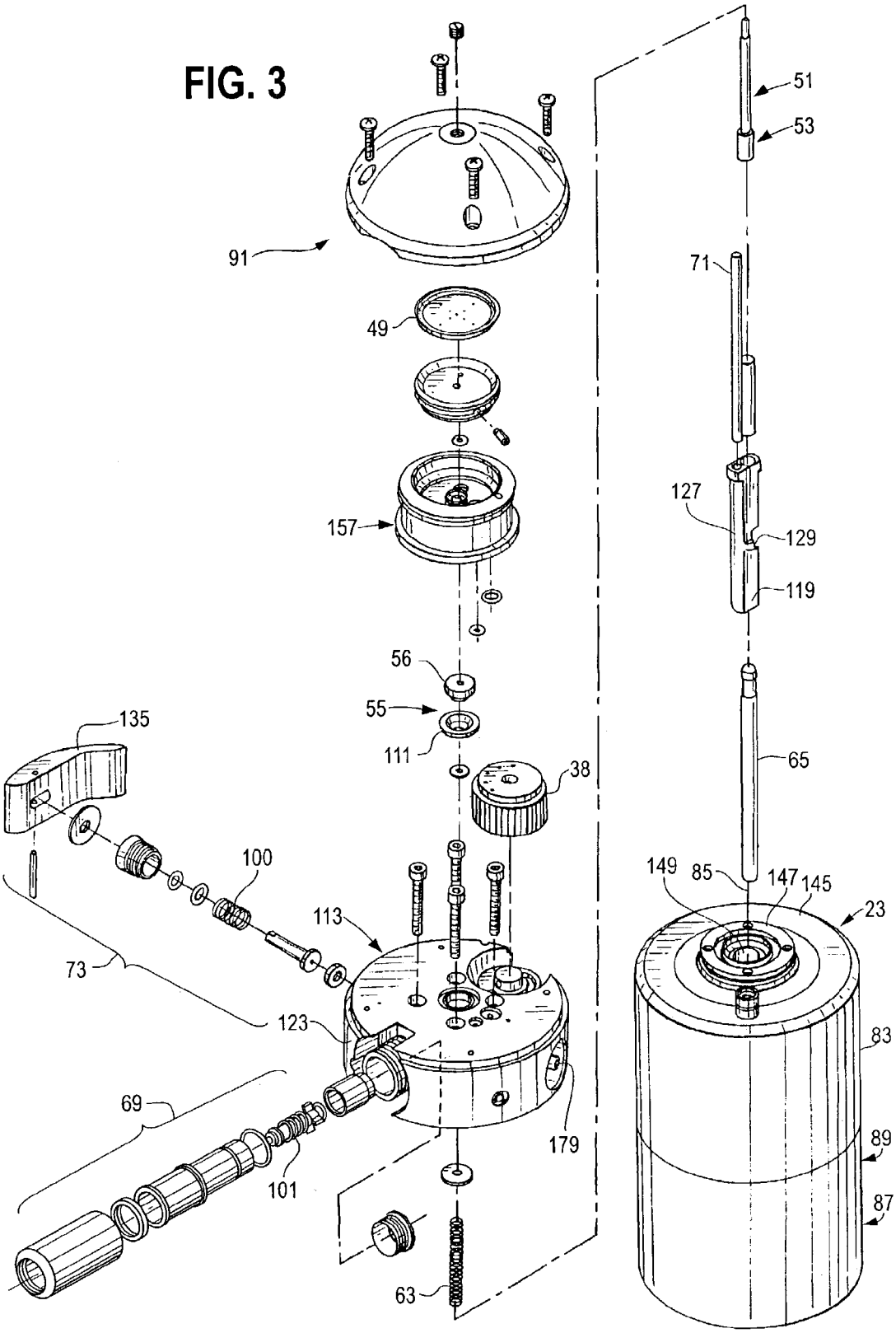
FIG. 3 is an exploded perspective view of the embodiment shown in FIG. 2.

Referring more generally to all the drawings, including FIGS. 1–3, regulator 33 preferably makes use of a transfer mechanism for thermal energy or heat, preferably in the form of a moveable probe 51 formed of heat conductive material. Probe 51 has a first portion 53 exposed to the pressure and temperature of chamber 25. Preferably, first portion 53 is not only exposed to the pressure and temperature of chamber 25, but is also physically positioned within chamber 25. A second portion 55 of probe 51 is connected to first portion 53, but is exposed to the ambient temperature, which, of course, is higher than the temperature in chamber 25. Preferably, second portion 55 is not just exposed to the ambient, but also has a portion extending outside of container 23. In this way, moveable probe 51 introduces heat from ambient 24 into chamber 25. The introduction of heat into chamber 25 affects the evaporation rate characteristic of cryogenic chamber 25, resulting in the liquid oxygen "boiling off" at a certain number of liters per minute.

Probe 51 is mounted to move relative to chamber 25 in response to variations in pressure in gas volume 31 within chamber 25. In particular, probe 51 includes inner surface 57 extending outwardly from the central axis of probe 51 and thereby defining a surface area exposed to the pressure of volume 31 of the oxygen gas. The exposure of inner surface 57 to the pressure of volume 31 need not be direct, but can occur indirectly, such as through a flexible membrane, diaphragm, or seal, such as seal 111. In this way, the pressure on inner surface 57 creates a force biasing probe 51 away from volume 31 of the gas in the direction indicated by the arrow A.

An opposing force is created by a biasing mechanism 61, preferably in the form of spring 63. Spring 63 is positioned to urge probe 51 toward the inside of chamber 25, that is, toward volume 31 of pressurized oxygen, preferably in a direction indicated by the arrow B. The direction of arrow B is generally opposite the direction of the force acting on inner surface 57 of probe 51. Thus, probe 51 moves relatively outwardly from chamber 25 in response to increasing pressure and relatively inwardly in response to decreasing pressure.

Spring 63 is shown as a coil-type spring coaxially received around the elongated portion of probe 51. Other types and locations of springs are likewise suitable, and other types of biasing mechanisms 61 are also suitable.

The balance of inward and outward forces can be tailored to the particular needs and configuration of the system 21. Preferably, the displacement of probe 51 into and out of chamber 25 is selected to alter the evaporation or "boil off" rate characteristic of the cryogenic system and to maintain the pressure of gas volume 31 at a corresponding pressure, plus or minus certain pressure variations.

The area of inner surface 57 and the characteristics of spring 63 are selected so that force on inner surface 57 moves probe 51 in the direction of arrow A when the pressure of volume 31 exceeds a predetermined upper threshold. The predetermined threshold is preferably any pressure which allows system 21 to delivery appropriate but not excessive amounts and rates of gaseous oxygen during operation. The movement of probe 51 outwardly from volume 31 of gas causes probe 51 to transfer less thermal energy to chamber 25. Conversely, biasing mechanism 61 moves probe 51 inwardly into volume 31 when the pressure falls below a lower threshold. In so doing, probe 51 transfers more thermal energy to the container. Once the pressure of gas volume 31 has passed the upper or lower threshold, the amount which probe 51 moves depends on the amount by which the pressure has exceeded the upper threshold, or fallen below the lower threshold.

The inner surface 57 of probe 51 thus serves as a detection mechanism which detects variations in the pressure of gas volume 31, and probe 51 thereby serves as a thermal transfer mechanism which either (1) increases the evaporation rate in response to the detection of a drop in pressure of volume 31, or (2) decreases the evaporation rate in response to the detection of an increase in pressure of volume 31. The movement of probe 51, when pressures of the gas volume pass the upper or lower threshold pressures, thus permits regulator 33 to regulate the pressure of volume 31 to remain generally at a given pressure or within a given pressure range between the upper and lower thresholds.

Regulator 33 preferably includes a second probe 65 secured and located within chamber 25 with one end oriented toward concave bottom 109 of chamber 25. Probe 65 terminates in a tip with a second probe surface 67 opposing a corresponding tip 66 of moveable probe 51. The tip 66 of variable probe 51 thus moves toward or away from the opposing surface 67 of probe 65. In this way, the heat present in the ambient is transferred from the outer, second portion 55 of probe 51, down through first portion 53, into probe 65, and into the volume 29 of liquid oxygen, such heat transfer or temperature gradient being shown schematically by arrows C (FIG. 1).

Heat transfer increases significantly when the opposing tips of probes 51, 65 contact each other, and conversely, heat transfer decreases significantly when such contact is substantially broken. Accordingly, in one preferred embodiment, the balance of inward and outward forces on the regulator 33 is tailored so that the moveable probe 51 simply moves into and out of contact with probe 65. In such embodiment, the relatively smaller decreases or increases in heat transfer, as probe 51 moves from a first, out-of-contact position with probe 65, to a second, out-of-contact position, are not as significant to regulating heat transfer and pressure. Instead, the probe movements into and out of contact maintain sufficient heat transfer and pressure in the system to deliver gaseous oxygen.

In the illustrated embodiment, liquid system 21 is substantially cylindrical or bullet-shaped and has first and second opposite ends 87, 91. A base 89 is defined at end 87. The liquid oxygen system 21 has a head 93 located at end 91. Longitudinal axis 85 (FIG. 3) extends between ends 87, 91. Probe 51 is mounted to slide longitudinally relative to container 23. As best seen in FIG. 2, probe 51 preferably comprises an elongated member with a head portion 56 having outer surface 59 and inner surface 57 both located proximate to upper surface 94 of head 93.

Seal 111 is disposed along inner surface 57 of head portion 56. Seal 111 is seated against both head 93 at the seal's outside perimeter and against probe 51 at its inner perimeter. Seal 111 thus forms part of the boundary between the pressures on its inner side exposed to chamber 25 and the pressure of ambient 24 on its opposite side.

Probe 51 has a shaft or elongated portion extending from head portion 56 through seal 111. The shaft extends into and terminates in volume 31 of the gas. The shaft or elongated portion of probe 51 includes suitable structures so that biasing spring 63 is coaxially received thereon and held in a tensioned state.

Head 93 of system 21 includes a manifold 113 with a series of chambers, cavities, openings, and passages suitably located to interconnect the various systems and components of system 21. With regard to probe 51, the elongated portion of probe 51 extends through a manifold chamber 115 defined by an inner wall of manifold 113. The elongated portion of probe 51 extends out of manifold chamber 115 and into a neck 117, leading to chamber 25.

Neck 117 includes suitable structures and features to keep probes 51 and 65 sufficiently aligned to operate as required to both transfer thermal energy and regulate the pressure of the volume of gas 31. Preferably, neck 117 includes an alignment piece 119 received therein. Alignment piece 119 has a bore extending longitudinally therethrough, the bore terminating in opposite openings. Moveable probe 51 extends at least partly into the bore through one of the openings, the tip of moveable probe 51 being positioned at a medial location within the bore. Probe 65 enters through the opposite opening of alignment piece 119 and has its tip extend to a medial location within the bore proximate to the tip of probe 51. In this way, the respective tips of probes 51 and 65 are opposing each other and substantially aligned, extending into alignment piece 119 from respective, opposite ends.

Manifold chamber 115 is suitably sealed from the ambient to experience the pressure associated with gas volume 31 during operation of apparatus or system 21. Accordingly, the inner surface of seal 111 and the corresponding inner surface 57 of probe 51 are exposed to the pressures of gas volume 31, and result in the outwardly directed force in the direction of the arrow A, discussed previously, acting to oppose the spring biasing force caused by spring 63 on moveable probe 51. Thus, under the appropriate pressure conditions discussed previously, moveable probe 51 slides outwardly relative to alignment piece 119, increasing the distance between the opposing tips of probes 51, 65.

Probes 51, 65 preferably have their respective, opposing tips or surfaces contoured to increase the respective, mating surface areas of such tips and thus increase the thermal transfer between the opposing tips. Although the tip of variable probe 51 is generally concave and the corresponding tip of probe 65 is convex, any other contour is likewise suitable, so long as the desired amount of thermal transfer occurs. In fact, although probes 51, 65 are preferably elongated and are shown to terminate in tips, it is understood that the probes need not be elongated, and need not end in tips; other shapes and configurations are suitable and can be designed to effectively transfer thermal energy and regulate the pressure of gas in system 21.

When probe 51 moves longitudinally, head portion 56 likewise is displaced longitudinally. A cavity 121 is defined in head 93 for receiving head portion 56 of probe 51 when it moves outwardly, and cavity 121 is sufficiently deep to accommodate the full range of motion of probe 51 which occurs during operation of regulator 33.

Figure 4:
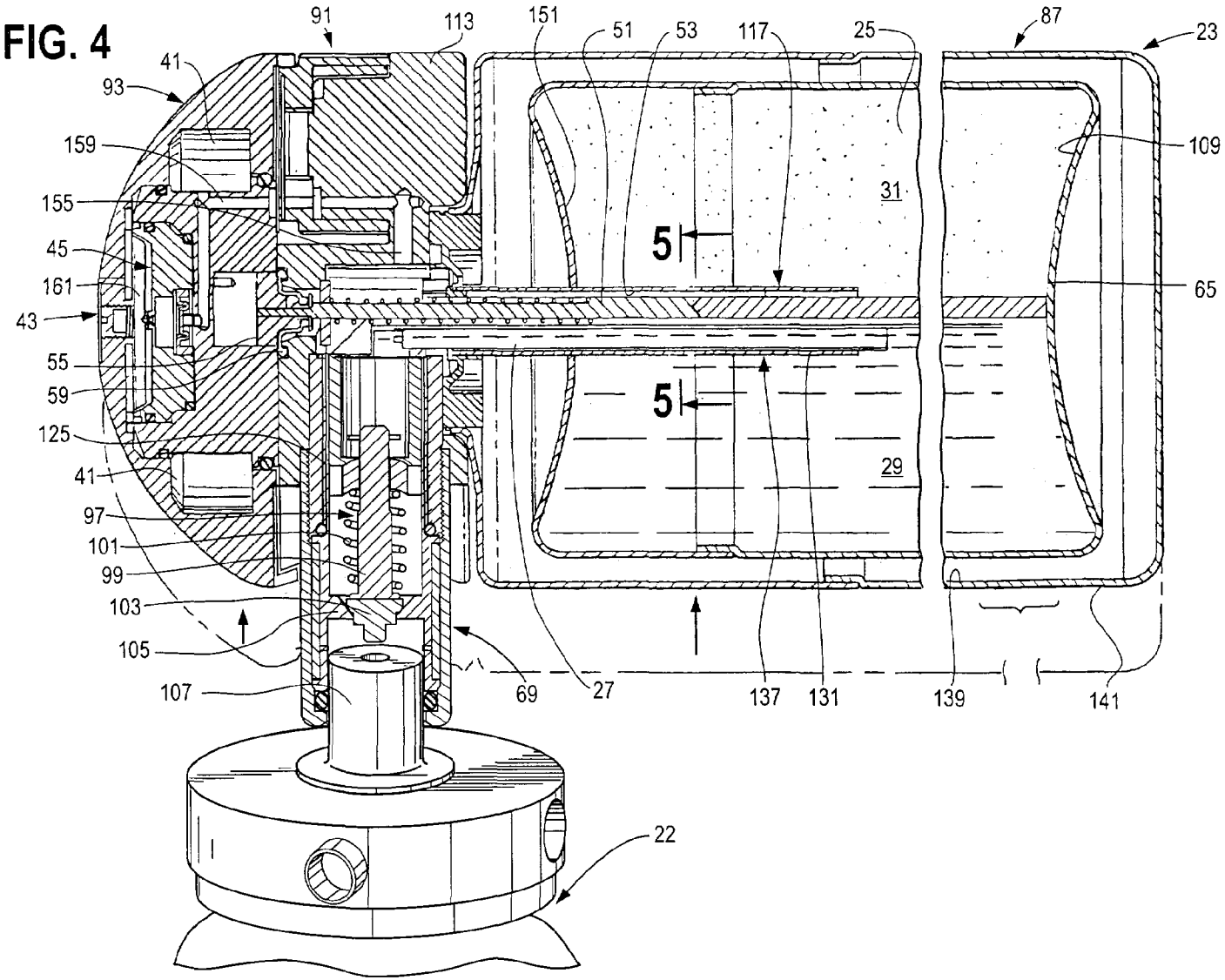
FIG. 4 is a cross-sectional view taken along line IV—IV of FIG. 3.

Referring more particularly to FIG. 4, fill system 27 is used to fill or charge system 21 with liquid oxygen. Fill system 27 includes fill chuck 69 structured to connect to a source 22 of oxygen in the liquid phase. In this case, source 22 comprises a base liquid oxygen unit. Fill chuck 69 is, in turn, in thermal connection to fill tube 71, which extends from fill chuck 69 into chamber 25 and terminates in an opening approximately in the middle of chamber 25.

Chamber 25 includes suitable vents, one of which is shown schematically at 73 in FIG. 1, for "blowing off" excess oxygen. Vent 73 (when open) is in communication with chamber 25 and fill system 27. The vent 73 and fill system 27 are configured so that chamber 25 becomes only partially filled, preferably about 50%, with liquid oxygen by operation of fill system 27. This assures that both the volume 29 of liquid oxygen and the volume 31 of gaseous oxygen are formed upon filling or charging the system 21.

Fill chuck 69 makes use of a poppet valve 97, in which poppet spring 101 biases poppet pin 99 and poppet seal 103 outwardly to seat and seal against annular seat 105. During the filling operation, mating outlet or nozzle 107 of base unit 22 unseats or unseals poppet valve 97 by urging it radially inwardly when nozzle 107 is inserted into fill chuck 69, in a known manner. A flow path for oxygen in liquid form is thus defined from the pressurized source in base unit 22, through nozzle 107 to exit base unit 22, into and through fill chuck 69 and fill tube 71, and into chamber 25.

Fill chuck 69 extends transversely and inwardly from the circumferential sidewall 123 of manifold 113, terminating at a central location at or proximate to manifold chamber 115. At this central location, the outer or upper end of fill tube 71 extends orthogonally from fill chuck 69, extending longitudinally into chamber 25. Although fill chuck 69 and fill tube 71 preferably join each other at a central location within manifold 113, the flow path defined by these elements is preferably not in fluid or pneumatic communication with manifold chamber 115 but remains insulated therefrom by suitable walls.

Fill chuck 69 is secured within a cavity of manifold 113 with suitable structures so that fill chuck 69 is substantially insulated from thermal contact with manifold 113 by insulated space 125. Insulated space 125 extends between the cylindrical sidewall of fill chuck 69 and the corresponding inner wall of manifold 113, over substantially all of the length of fill chuck 69. In this way, liquid oxygen passing through fill chuck 69 absorbs minimal heat from the manifold 113 by virtue of the insulated space 125 therebetween.

Figure 5:
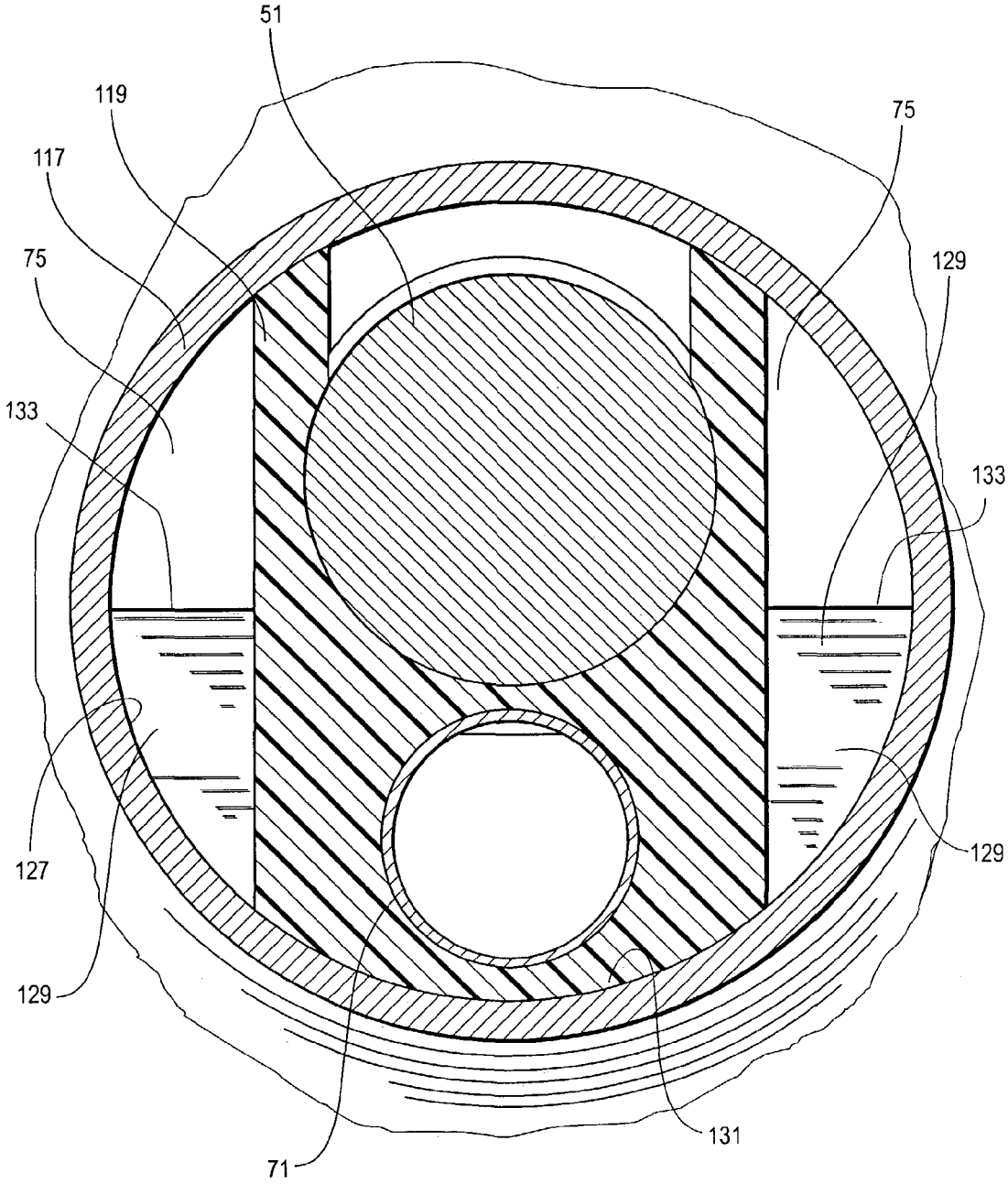
FIG. 5 is an enlarged, cross-sectional view taken along line V—V of FIG. 4.

A trapping mechanism 127, best seen in FIGS. 2 and 5, reduces leakage of the liquid phase out of the container which would otherwise occur during filling of the container from approximately 40% to 50% of its capacity. As best seen in FIG. 5, trapping mechanism 127 includes a set of wings 129 which extend from alignment piece 119 radially outwardly to abut the inner cylindrical wall of neck 117. By virtue of this structure, it will be appreciated that when the portable liquid oxygen apparatus 21 is turned on its side for filling as shown in FIG. 4, once the level of liquid oxygen reaches the lower wall portion 131 of neck 117, further rising of the level of liquid oxygen in volume 29 is impeded from flowing out neck 117 by wings 129. Wings 129 thus act as a dam to keep liquid oxygen from flowing into manifold chamber 115 and potentially boiling off and out the various relief valves provided in apparatus 21.

Although fill system 29 includes a trapping mechanism 127 to avoid the inadvertent release or entrainment of liquid oxygen during filling, once the level of liquid oxygen passes the upper edge 133 of wings 129, the liquid oxygen is free to flow past wings 129, out neck 117, and into manifold chamber 115. Once in manifold chamber 115, the contact of liquid oxygen with manifold 113 generally introduces sufficient heat energy to entrain or partly evaporate such liquid oxygen out of system 21. Manifold chamber 115 is in pneumatic communication with one or more relief valves or vents to atmosphere, including vent 73. As such, if the user continues to try to fill liquid oxygen system 21 beyond the approximately 50% fill level, liquid oxygen will flow back up neck 117 and be vented out of the system. This maintains chamber 25 only about 50% filled with a volume 29 of liquid oxygen and the remainder filled with a gas volume 31 of pressurized oxygen. The partial filling of chamber 25 thus forms a "head space" of pressurized oxygen above the volume 29 of liquid oxygen, and it is this head space of pressurized oxygen which is drawn upon to meet the user's breathing needs, as explained subsequently.

Vent 73 preferably comprises a vent-to-atmosphere with a passage extending generally transversely from manifold chamber 115 outwardly to terminate at the atmosphere at a suitable location on sidewall 123 of manifold 113 (FIGS. 2–3). Vent to atmosphere 73 includes handle 135 with a cam at its end. When handle 135 is pulled outwardly by the user, a flow path is opened between manifold chamber 115 and the atmosphere. The flow path vents excess liquid oxygen with which a user may attempt to charge the system after it has been filled to the approximately 50% capacity preferable for this invention. This flow path likewise allows gas to escape chamber 25 during operation of fill system 27 to charge apparatus 21 with liquid oxygen.

Flow rate controller 37, vent-to-fill valve 73, fill chuck 69, and nozzle 179 are secured to head 93 at respective angular locations thereon, and are located to be accessible by the user from the circumferential sidewall 123 of head 93.

Fill tube 71 and fill chuck 69 include cylindrical walls which are preferably made as thin as structurally possible, and preferably of a material with a very low thermal conductivity. In this way, the fill system emits a very low amount of heat energy or BTUs to the liquid oxygen as it passes through fill system 27, promoting more efficient filling of system 21.

Insulated container 23 is preferably a double-wall container, that is, one having an inner wall 139 which defines chamber 25 therein, and an outer wall 141 which extends in spaced relation to inner wall 139 to define in insulating region 143 between the inner and outer walls 139, 141. To improve the insulative characteristics of insulating region 143, it is generally evacuated of air to form a vacuum. Outer wall 141 includes an end portion 145. End portion 145 has a flange or mounting bezel 147 secured thereto at a central location. Flange 147 is configured so that head 93 can be secured to it, thus securing the various components of head 93 in operative relation to the container 23. Flange 147 is preferably annular and defines a flange opening 149 leading into chamber 25 which allows fluid communication between manifold chamber 115 in head 93 and chamber 25 of container 23.

Neck 117 is preferably defined by a cylindrical sidewall 137 which extends from the flange opening 149 in outer wall 141, past end portion 151 of inner wall 139, and into chamber 25. The sidewall 137 of neck 117 terminates within chamber 25 at a medial location, preferably one proximate to the volumetric center of the volume defined by inner wall 139.

Sidewall 137 of neck 117 define a cross-sectional area which is sized to receive therein, either wholly or partially, several of the operative components described previously, including the alignment piece 119, probes 51, 65, and fill tube 71. The arrangement of these components nonetheless does not completely occupy the cross-sectional area of neck 117, leaving open at least one, longitudinal passage 75.

Passage 75 delivers gaseous oxygen from volume 31 to delivery system 35. Passage 75 has an opening located in the middle of chamber 25 by virtue of neck 117 terminating at such middle location. This configuration makes it very difficult for oxygen in the liquid phase to inadvertently exit through passage 75 during use of liquid oxygen system 25, no matter how the user may turn it during use thereof. This is especially important when system 21 is portable, as in the preferred embodiment of this invention, since such portable systems may be turned, jostled, or may be otherwise not resting on their bases while in use. By way of example, if liquid system 21 were turned on its head, volume 29 of liquid oxygen would move from base 89 and collect at the opposite end of chamber 25 along end portion 151 of inner wall 139. During such movement, the slight amount of liquid oxygen which may enter neck 117/passage 75 is generally insufficient to escape system 21 in liquid phase, generally boiling off harmlessly; furthermore, once system 21 is turned on its head, the extension of neck 117 into chamber 25 exceeds the level of the liquid oxygen received therein, due to the partial filling of chamber 25. As such, no further liquid oxygen escapes out neck 117. The same principles apply to any orientation of system 21 during its use to prevent inadvertent release of liquid oxygen.

The above features of system 21 improve the efficiency at which liquid oxygen is used by avoiding excess "boil off" or entrainment of liquid oxygen when the system is inverted or turned. In other words, the liquid oxygen in system 21 is depleted at rates substantially independent of the orientation of container 23, since no inadvertent or excess use of liquid oxygen occurs when the system is inverted or turned during use.

The upper end of passage 75 serves as the inlet for gaseous oxygen to enter delivery system 35. The upper end of passage 75 connects to manifold chamber 115. Manifold chamber 115 is in communication with flow rate controller 37 by means of passage 155 (FIG. 1). Flow rate controller 37 includes a user-rotatable dial or selector 38. Selector 38 is rotatably mounted to manifold 113 at a suitable angular location thereon so that it is accessible by the user to turn it to select the desired flow rate (FIGS. 3, 4).

Flow rate controller 37 is in communication with conserver 43. Preferably, conserver 43 comprises part of head 93, is located adjacent to manifold 113 along longitudinal axis 85, and is secured to opposing upper surface 94 of manifold 113. Conserver 43 includes a reservoir manifold 157 with a passage 159 defined therein communicating between the selected orifice 39 of flow rate controller 37 and reservoir 41 of conserver 43. Thus, gas flows from manifold chamber 115, through passage 155 (FIGS. 1 and 4) to orifice 39, through passage 159 in reservoir manifold 157, and into reservoir 41. The flow is such that reservoir 41 gets charged with a volume of gaseous oxygen at a corresponding pressure, such volume determined by the size of orifice 39 selected by the user.

The general operating principles of one suitable pneumatic-type conserver are described in co-pending application Ser. No. 10/040,190, of common assignee, the teachings of which are incorporated herein by reference.

The gas in manifold chamber 115 charges conserver chamber 161 (FIG. 2) through suitable passage 163 (FIG. 1). Sensing diaphragm 49 is mounted at the upper edge of reservoir manifold 157 (FIG. 2) and comprises part of sensing system 45 (FIG. 1). As such, sensing diaphragm 49 is normally seated against an orifice 165. Orifice 165, in turn, communicates with conserver chamber 161. Chamber 161 is also in communication with dump diaphragm 50, which is shown mounted below conserver chamber 161 and sensing diaphragm 49 in the drawings (FIG. 2). It will be appreciated that in conservers of the pneumatic type, dump diaphragm 50 is seated against a corresponding orifice 167 by virtue of the pressure maintained in conserver chamber 161. Sensing diaphragm 49, in turn, is generally seated by a suitable mechanical force urging it toward orifice 165, such as an adjustment screw spring. Passage 169 (FIG. 1) is suitably defined within head 93 so that the outer side of sense diaphragm 49, that is, the side opposite conserver chamber 161, is in communication with gas line 47 connected to the user. Similarly, delivery passage 171 (FIGS. 1, 2, 4) has been defined at suitable locations within head 93, including through reservoir manifold 157 and manifold 113, to connect reservoir 41 to gas outlet 173, whereby the gas from reservoir 41 is delivered out outlet 173, through gas line 47 to the user. Outlet 173 has been configured to form nozzle 179 for attaching to a correspondingly-shaped end of gas line 47. Conserver 43 is configured so that delivery passage 171 is opened or closed by the corresponding opening or closing of orifice 167 by dump diaphragm 50. Vent to atmosphere 175 (FIG. 1) is defined by suitable portions of head 93 to lead from the side of sensing diaphragm 49 which seals against orifice 165 out to the ambient.

Although conserver 43 has been described with reference to one type of pneumatic device, any number of alternate pneumatic configurations would be suitable to enable delivery system 35 to operate, and even non-pneumatic conservers 43 are suitable.

Having described the various structures and features of the cryogenic, gas delivery system 21, its operation is readily apparent to those skilled in the art. A volume 29 of liquid oxygen needs to be introduced into chamber 25, and a volume 31 of pressurized oxygen needs to be generated within chamber 25. Gas volume 31 needs to be charged or pressurized up to the predetermined baseline pressure for the system 21. In this embodiment, to achieve a baseline pressure of about 50 psi, regulator 33 is preferably configured so that first portion 53 of variable probe 51 abuts against opposing surface 67 of probe 65 during the initial stages of filling system 21 with liquid oxygen from base unit 22 (FIG. 4). In this fully biased position, regulator 33 introduces the maximum amount of thermal energy into system 21 to "charge" it up to the required baseline pressure. As the system fills, and the volume 31 of pressurized oxygen approaches the desired baseline pressure, such pressure urges probe 51 away from probe 65, thereby reducing the amount of thermal energy introduced into chamber 25. Eventually, regulator 33 reaches an equilibrium and maintains the pressure of volume or headspace 31 within the predetermined range of baseline pressures and corresponding evaporation rates, as discussed previously, during operation of system 21.

System 21 is preferably charged by being connected to a base unit 22, such as that shown in FIG. 4. Prior to filling, vent-to-fill valve 73 is actuated by the user's rotating the handle 135 so that its cam opens valve 73. During filling, gaseous oxygen escapes through vent-to-fill valve 73, permitting the volume 29 of liquid oxygen to enter chamber 25. Filling of chamber 25 with liquid oxygen continues with system 21 on its side in this embodiment, with liquid oxygen eventually encountering the trapping mechanism 127, and eventually reaching a level corresponding to upper edge 133 of wings 129. Further filling of the device 129 is impeded at this point as liquid oxygen begins to flow back out neck 117 into head 93, where it boils off or exits the system. Vent-to-fill valve 73 is then closed and system 21 disconnected from base unit 22.

The fact that oxygen delivery passage 75 opens into chamber 25 near its volumetric center permits system 21 to be held in any orientation during filling and yet still only be partly filled with liquid oxygen when the filling is complete. Thus, for example, if, in an alternative embodiment, the connection between base unit 22 and system 21 were to orient the system 21 in an upright position, the pressure of the gas volume 31 acting on the liquid oxygen volume 29 would generally cause liquid oxygen to flow back out passage 75 once the chamber becomes about 50% full. Similarly, if system 21 were being filled in a completely inverted position, liquid oxygen would fill to the level corresponding to the opening of passage 75, about 50% of the volume of chamber 25, and thereafter would begin to flow out of passage 75.

Once system 21 has been charged with the appropriate volume of liquid oxygen, the back flow or out flow of excess liquid oxygen exits vent 73 with enough steam and entrained liquid oxygen so as to be discernible to the user. The venting of excess liquid oxygen thus signals to the user that the system is fully "loaded" or "charged" for subsequent use.

After the system 21 has been charged and disconnected from its filling source, it is available for both sedentary and ambulatory applications. The gas to be delivered to the user enters delivery system 35 from chamber 25 in gaseous—not liquid—phase. Gaseous oxygen exits container 23 from gas volume 31 through passage 75, and flows through the user-selected orifice 39 of flow rate controller 37. The orifice selection controls the saturation or delivery rate of oxygen to the user. The delivery system 35 is calibrated so that orifices 39 correspond to the delivery to the user of different saturation levels or volumes of oxygen per minute. Flow-rate controller 37 thus allows the user to set the system to achieve the saturation or liters per minute of oxygen prescribed by medical circumstances, or as required to suit particular activities of the user.

During use of system 21, a variety of factors may cause the pressure of volume 31 to vary; however, regulator 33 responds to such variations by moving probe 51 toward or away from chamber 25, as required. Thus, for example, a user may place increased oxygen demands on the system, either by breathing more frequently or selecting a larger delivery volume by appropriate turning of flow rate selector 38. If such actions create a drop in pressure, it is only momentary, because regulator 33 operates to increase the transfer of thermal energy into the system by moving probe 51 toward chamber 25. More gaseous oxygen boils off as a result, returning the pressure of chamber 25 to the baseline pressure range. The converse occurs if the system is not used, or if oxygen demand decreases.

If the system 21 is charged but not used for a certain amount of time, the "use-it-or-lose-it" nature of liquid oxygen is such that it continues to evaporate at the rate which characterizes system 21. Accordingly, container 23 is equipped with suitable relief valves to maintain the appropriate baseline pressure in volume 31 when no oxygen is being drawn out of chamber 25 by delivery system 35. A primary relief valve (not shown) is provided to avoid over-pressurized conditions. Additionally, when vent-to-fill valve 73 is closed, it serves as a secondary relief valve. When the pressure in head 93 exceeds a predetermined, secondary threshold, the pressure acts against the force of spring 100 to urge seal 103 away from its seat 105 and opens valve 73 to atmosphere.

Inhalation by the user creates a negative pressure in distal end 77 of gas line 47 connected to the user. The negative pressure travels through gas line 47. The other end of gas line 47 is in communication with sensing system 45, so the negative pressure is transmitted to sensing system 45, where it acts upon sense diaphragm 49. There, the negative pressure unseats diaphragm 49 from orifice 165 against which it is biased and, by opening such orifice, a flow path is established which vents pressurized oxygen from the other side of diaphragm 49 through vent to atmosphere 175. The venting of pressurized oxygen to atmosphere, in turn, reduces pressure in conserving chamber 161 sufficiently so that dump diaphragm 50, which is normally biased against orifice 167 to close reservoir 41, opens in response to the reduced pressure. The opening of reservoir 41 creates a flow path from reservoir 41 to gas line 47, thereby delivering gas from reservoir 41 as a pulse to the user in response to inhalation.

Passage 163 to conserver chamber 161 includes a restriction 177 (FIG. 1). Restriction 177, orifices 165, 167, and other flow characteristics of conserver 43, are all selected or tuned so that gas pressure is returned to appropriate locations in conserver 43 at suitable times and pressures. As such, the appropriate amount of oxygen is delivered to the user before the pressures reseat dump diaphragm 50 to end oxygen delivery to the user.

The above-described process for delivering oxygen to the user is repeated in response to the inhalation pattern of the user. Oxygen is thus continually drawn off of gas volume 31 over time, and the gas volume 31 is replenished by evaporation of the liquid oxygen in chamber 25. The evaporation rate of such liquid oxygen is regulated by regulator 33, as discussed previously, to assure that volume 31 remains sufficiently charged during the operation cycle by the user. The system continues to supply needed oxygen until the volume of liquid oxygen 29 is depleted. At this point, the system is refilled with liquid oxygen by any suitable means, including in the manner discussed previously, and the user again is free to operate the system through a range of activities.

Liquid oxygen system 21 can be sized and configured in any number of ways, so long as the system evaporates sufficient liquid oxygen, which, in turn, is drawn off by delivery system 35 in volumes sufficient to supply the user's needs through the range of such user's activities. In one preferred embodiment, the chamber 25 and regulator 33 are configured so that the system 21 has an evaporation rate capable of ranging from 0.4 liters to 1.5 liters per minute. Conserver 43 is configured to cause a four-fold increase in the effective volume of oxygen delivered to the user. Flow rate controller 37 includes orifices 39 corresponding to effective delivery volumes ranging between one and four liters per minute.

Regulator 33 preferably has variable probe 51 with its elongated portion or shaft made out of copper and, optionally, its head portion 56 made of metallic material, preferably copper as well. Probe 65 is preferably made of a metal with high heat conductivity, more preferably copper.

In contrast, to reduce transfer of thermal energy, fill system 27 preferably makes use of stainless steel, such as in chuck 69 and fill tube 71. The baseline pressure is preferably about 50 psi, plus or minus about 2 psi, making the lower pressure threshold about 48 psi, the upper pressure threshold about 52 psi, and the range between the thresholds about 4 psi. Under normal operations, the gap between the opposing tips of probes 51, 65, is about one quarter inch.

The volume of chamber 25 is preferably about 39 cubic inches, resulting in volume 29 of liquid oxygen being about 19 cubic inches, and volume 31 of gaseous oxygen being about 20 cubic inches when the system has been fully charged with oxygen.

The various passages and orifices in conserver 43 are sized so that conserver 43 acts, in a sense, like a "clock," determining how long for reservoir 41 to charge to its desired pressure and how long to leave dump diaphragm 50 open for delivery of oxygen through gas delivery line 47. Although many different combinations of orifices and passage sizes can achieve the desired "clocking" function of conserver 43, one suitable set of dimensions is as follows: 0.0015 to 0.0020 inches for restriction 177 in pressure line passage 163, 0.008–0.014 inches for orifice 165 for sensing diaphragm 49, and 0.040 to 0.100 inches for orifice 167 for dump diaphragm 50.

Although the invention has been described with reference to certain preferred embodiments, alternative embodiments are likewise within the scope of the present invention. For example, system 21 can be designed without requiring fixed probe 65, so long as variable probe 51 introduces sufficient thermal energy to charge delivery system 35 with the required amount of gaseous oxygen. Still further, regulator 33 can be replaced entirely with a system of structures extending from the ambient into the container, that is, there is no need for a movable probe 51 or a probe 65. In this alternative, the structures entering chamber 25 would be sufficient to charge delivery system 35 for all intended uses.

In still another alternative, the system could include means for the user to set the distance between probes 51 and 65, the varying of the distance resulting in a corresponding variation in the evaporating rate of oxygen and a corresponding variation in the volume of oxygen delivered to the user through the delivery system 35.

Excess evaporation could be vented to atmosphere under these alternative scenarios.

In further alternatives, the physical location of conserver 43 can be varied from its preferred position longitudinally adjacent to head 93.

In still further embodiments, conserver 43 need not be secured to system 21, that is, it need not be secured to either container 23 or head 93. Instead, conserver 43 can either be dispensed with entirely or incorporated remotely from the portable system 21. Conserver 43 is alternately any other type of pneumatic conserver, including one without a reservoir, or any non-pneumatic type.

As still further alternatives, flow rate controller 37, vent-to-fill valve 73, fill chuck 69, and nozzle 179 need not all be secured at respective angular locations in head 93, but can instead by interconnected at different locations relative to container 23, so long as the various systems remain operatively connected to each other to effectuate the operation of system 21 as intended.

The ratio of gas volume 31 and gas volume 29 need not be 1 to 1, that is, the partial filling of system need not be only at 50%. Rather, suitable traps or other structures can be implemented to permit increased amounts of liquid oxygen, or less liquid oxygen can be used in the system.

The advantages of the invention are apparent from the foregoing description.

As one advantage, gas is delivered by a delivery system without using high pressure gas cylinders.

Another advantage is that a liquid oxygen system is provided which does not need warming coils to deliver oxygen in gas form.

As still a further advantage, the invention makes use of a fill system which is structured and located to charge the system with liquid oxygen more efficiently by reducing the amount of thermal energy to which the liquid oxygen is exposed during the filling operation.

As yet another advantage, the invention reduces the inadvertent escape of liquid oxygen from the system because it is structured to fill only partially, and locates the various fill and delivery components at medial locations within chamber 21. This allows liquid oxygen in the system to be used more efficiently.

Having described the invention with certain preferred and alternative embodiments, it is understood that still further alternatives and variations are possible, as skill or fancy may suggest, and such variations are likewise within the scope of the present invention, which is only limited by the following claims, and is not limited by the preferred embodiments described herein.

What is claimed is:

1. A cryogenic gas delivery apparatus, comprising:

a chamber adapted to contain a cryogenic liquid and corresponding gas, the liquid at a temperature below that of the ambient, the gas at a pressure above that of the ambient;

at least one heat-conductive probe with a first portion exposed to the ambient, so that the probe introduces thermal energy from the ambient into the chamber; and a passage in communication with the gas in the chamber to receive the gas from the chamber for delivery to the user;

wherein the probe is mounted to move relative to the chamber in response to variations in the pressure of the gas, thereby varying the amount of the thermal energy introduced into the chamber.

2. The apparatus of claim 1, further comprising:

a delivery system configured to deliver the gas over time to the user, the delivery system in communication with the passage to receive the gas from the chamber.

3. The apparatus of claim 2, wherein the delivery system comprises a pneumatic conserver, the conserver having a sensing system adapted to discharge the gas in response to inhalation by the user.

4. The apparatus of 3, wherein the conserver further comprises a reservoir charged by the gas exiting the chamber, and wherein the sensing system is operatively connected to the reservoir.

5. The apparatus of claim 1, further comprising a flow-rate controller in communication with the passage, flow-rate controller having multiple settings for delivering correspondingly different volumes of the gas over time.

6. The apparatus of claim 1, further comprising a fill system configured to fill the chamber only partially with the liquid.

7. The apparatus of claim 6, wherein the fill system includes a fill tube terminating in an opening approximately in the middle of the chamber, and a fill chuck connected to the opposite end of the fill tube and having a fill chuck valve adapted to connect to a source of the cryogenic liquid;

wherein the apparatus further comprises a manifold secured to one end of the chamber, the manifold having been defined so that the fill chuck and the fill tube at least partially extend therethrough, the fill chuck secured relative to the manifold to define an insulated space between the fill chuck and the manifold over substantially all of the length of the fill chuck, whereby the liquid passing through the fill chuck absorbs minimal heat from the manifold.

8. The apparatus of claim 6, wherein the fill system has a trapping mechanism to reduce leakage of the liquid out of the chamber which would otherwise occur during filling of the chamber from approximately 40% to 50% of capacity of the chamber.

9. The apparatus of claim 6, wherein the fill system includes a fill chuck with a first sealed opening adapted to unseal in response to connecting the fill chuck to a base unit for filling, and a second sealed opening adapted to unseal in response to excess pressure of the gaseous oxygen in the chamber.

10. The apparatus of claim 1, further comprising a double-wall container, the inner wall of which defines the chamber and the outer wall extends in spaced relation to the inner wall to define an insulating region between the inner wall and the outer wall, the insulating region being substantially evacuated of air to form a vacuum.

11. The apparatus of claim 1, wherein the probe comprises a first probe with the first portion located in the chamber and the second portion located outside the chamber, the apparatus further comprising a second probe secured within the chamber and having a second probe surface opposing the first portion of the first probe to transfer heat from the first probe to the second probe.

12. The apparatus of claim 11, further comprising a sleeve secured to extend into the chamber and sized to slidably receive the first probe therein in opposing relation to the second probe.

13. A portable liquid oxygen system for delivering gaseous oxygen to a user, the system comprising:

a container sufficiently insulated from the thermal energy of the ambient to hold oxygen in both the liquid phase and the gas phase inside the container; and a delivery system adapted to deliver a sustained, breathable supply of oxygen to the user through an inlet in communication with oxygen in the container in the gas phase rather than the liquid phase, the delivery system having an outlet for connecting to the user to deliver the gaseous oxygen, and a conserver connected between the inlet and the outlet and operable in response to inhalation to deliver the gas to the user.

14. The system of claim 13, further comprising a thermo-pneumatic regulator secured to the container to vary the amount of thermal energy transferred to the container in response to variations in the pressure of the gaseous oxygen in the container.

15. The system of claim 14, wherein the container includes an inner wall defining a volume, the inlet of the delivery system located relative to the volume of the container to reduce unintended loss of the liquid phase from the container irrespective of how the user may orient the liquid oxygen system during use thereof.

16. The system of claim 13, further comprising a fill system configured to fill the container only partially with oxygen in the liquid phase, thereby defining a liquid oxygen volume and a headspace of pressurized oxygen gas in the container.

17. The system of claim 16 wherein the inlet includes a sleeve extending into the container and ending at an opening in the container, the opening spaced from the inner wall of the container and positioned approximately in the middle of the container, whereby the opening of the inlet cannot be located in the volume of oxygen in the liquid phase, irrespective of the orientation of the container.

18. The system of claim 14, wherein the regulator comprises a heat-conductive, elongated member having a first portion located in the container and exposed to the temperature therein and a second portion connected to the first portion and exposed to the ambient temperature.

19. The system of claim 18, wherein the elongated member includes an inner surface exposed to the pressure of the container and mounted to move in a first direction when the pressure exceeds an upper threshold, the regulator adapted to transfer less thermal energy to the container in response to the movement of the elongated member in the first direction.

20. The system of claim 19, wherein the regulator further includes a biasing mechanism to move the inner surface in a second direction when the pressure falls below a lower threshold, the regulator adapted to transfer more thermal energy to the container in response to movement of the elongated member in the second direction.

21. A portable, liquid oxygen system for delivering oxygen gas to a user, the system comprising:

a container sufficiently insulated from the ambient to hold oxygen in the form of both liquid oxygen and oxygen gas, the container characterized by a range of evaporation rates at which the liquid oxygen is evaporated within the container to become the oxygen gas;

a fill system configured to fill the container only partially with the liquid oxygen to define a volume of liquid oxygen therein and a volume of pressurized oxygen gas therein;

a delivery system having an inlet connected to the volume of oxygen gas for receiving the oxygen gas from the container, and an outlet for connecting to the user to deliver the oxygen gas;

a thermo-pneumatic regulator adapted to detect variations in the pressure of the volume of the oxygen gas, and to increase the evaporation rate in response to the detection of a predetermined drop in pressure of the volume of the oxygen gas, and to decrease the evaporation rate in response to the detection of a predetermined increase in pressure of the volume of the oxygen gas, whereby the regulator regulates the pressure of the volume of the oxygen gas to remain within a selected baseline pressure range;

wherein the regulator is adapted to charge the delivery system with the oxygen gas in sufficient amounts to fulfill the user's breathing needs as the liquid oxygen is evaporated within the container.

22. The apparatus of claim 21, wherein the apparatus is substantially cylindrical and has opposite ends, the apparatus having a base defined at one of the ends and a head defined at the other of the ends;

wherein the container has a top, a bottom, and a longitudinal axis extending between the top and the bottom, the head being secured to the top of the container, the container having a neck located in the top, the neck defining a passage between the head and the container, the inlet of the delivery system including a sleeve extending longitudinally from the neck into the container and positioned approximately in the middle of the container;

wherein the fill system comprises a fill chuck and a fill tube, the fill chuck secured to the head and extending outwardly from the longitudinal axis, the fill tube having one end secured to the fill chuck extending longitudinally into the container through the sleeve;

wherein the fill system further includes a vent-to-fill valve operatively connected to the fill chuck, the delivery system further including a flow-rate controller and a conserver located between the inlet and the outlet for delivering a selected amount of the gas over time, the outlet terminating in a nozzle adapted to connect to a gas line for the user to breathe through;

wherein the head includes a circumferential sidewall;

wherein the flow-rate controller, the vent-to-fill valve, the fill chuck, and the nozzle are secured to the head at respective angular locations and are located to be accessible by the user from the circumferential sidewall.

23. The apparatus of claim 22, wherein the regulator includes at least one probe extending at least partially into the container, the probe being slidably received in the neck of the container.

24. The apparatus of claim 22, wherein the head includes a manifold positioned adjacent to the container along the longitudinally axis, and further comprising a conserver positioned longitudinally adjacent to the manifold.

25. The apparatus of claim 24, wherein the manifold has an inner manifold wall defining a manifold chamber, the manifold chamber in communication with the volume of pressurized oxygen gas and with the regulator.

26. A regulator for a cryogenic gas delivery apparatus, the apparatus containing the liquid at a temperature below a higher, ambient temperature, and the gaseous phase being above ambient pressure, the regulator comprising:

at least one probe having first and second portions, the first portion being positioned relative to the volume of the gas to expose the first portion to the pressure and temperature of the volume of gas, the second portion being located to be exposed to the higher, ambient temperature to conduct heat from the ambient to the volume;

wherein the first portion is configured to increase the conduct of heat to the volume of liquid in response to the first portion being exposed to a decreasing pressure of the volume of gas and to decrease the conduct of heat to the volume of gas in response to the first portion being exposed to an increase in the pressure of the volume of gas.

27. The regulator of claim 26, wherein the probe comprises an elongated member having a head portion and an end portion, the head portion having inner and outer surfaces, the inner surface exposed to the pressure of the volume of the gas, the pressure on the inner surface biasing the elongated member away from the volume of gas, the outer surface exposed to the temperature of the ambient, the end portion having a surface extending into the volume of the gas; and a biasing mechanism to bias the elongated member toward the volume of the gas, whereby the amount of heat transferred to the volume of gas varies depending on the location of the elongated member relative to the volume of the gas.

28. The regulator of claim 26, further comprising a passage through which gas in the gaseous phase may flow from the volume of the gas and past the first portion of the probe for delivery of the gas in the gaseous phase.

29. The regulator of claim 26, further comprising a seal disposed between the first and second portions of the probe, the seal having a first side exposed to ambient pressure and a second side exposed to the pressure of the volume of the gas, the seal engaging the probe sufficiently to maintain the ambient pressure and the higher pressure of the volume on respective sides of the seal.

30. A method of charging a portable liquid oxygen system, comprising the steps of:

providing an insulated container with a vent for discharging excess oxygen and a passage in communication with the vent, the passage having an opening at a location spaced from the inner wall of the container;

initiating the filling of the container with oxygen from a supply of liquid oxygen under pressure by connecting the container to the supply;

continuing the filling process to fill the volume available in the container only partially with liquid oxygen, the filling process continuing until the volume of the liquid oxygen in the container reaches a level high enough so that the liquid oxygen enters the opening of the passage and exits the vent in a fashion discernable to the user charging the system; and disconnecting the container from the supply once the liquid oxygen is discerned to be exiting from the vent, whereby the container is charged with the partial amount of the liquid oxygen resulting from the filling process.

31. The method of claim 30, wherein the opening is substantially in the middle of the volume defined by the insulated container, and further comprising the step of continuing the filling process until the volume of the container is about 50% filled with the liquid oxygen.

32. The method of claim 30, further comprising the step of introducing thermal energy from the ambient into the container by means of a thermally conductive path, the path exposed on one end to the temperature of the ambient and on another end to the volume defined by the insulated container, the introduction of thermal energy being sufficient to increase the pressure within the insulated container to an operational, baseline pressure.

33. The method of claim 32, wherein the insulated container has a given evaporation rate when the system is charged, and further comprising the step of introducing thermal energy into the insulated container before the system is charged to create an evaporation rate higher than the given evaporation rate, and thereby shorten the time to charge the system.

34. A method of dispensing oxygen gas from a liquid oxygen system, comprising the steps of:

providing an insulated container with a chamber adapted to be only partly filled with oxygen in the liquid phase, thereby creating a liquid oxygen volume and a volume of oxygen gas in the chamber;

maintaining the volume of the oxygen gas at pressures above ambient;

dispensing a sustained, breathable supply of the oxygen gas to a recipient through a passage in communication with the volume of the oxygen gas;

wherein the step of dispensing the oxygen including receiving the oxygen gas through the passage irrespective of the orientation of the chamber.

35. The method of claim 34, wherein the dispensing step including not receiving in the passage any dispensable amounts of the oxygen in the liquid phase, no matter how the container may be turned during use.

36. The method of claim 34, wherein the dispensing step further includes depleting the liquid oxygen in the container at rates substantially independent of the orientation of the container.

37. The method at claim 34, further comprising the step of introducing thermal energy into the insulated container through a heat conductive path between the ambient and the chamber.

38. The method of claim 37, wherein the step of introducing thermal energy further includes increasing the evaporation rate in response to a decrease in the pressure of the volume of gas and decreasing the evaporation rate in response to an increase in the pressure of the volume of gas.

39. The method of claim 38, further comprising the steps of exposing more of the heat-conductive path to the inside of the chamber to increase the evaporation rate and exposing less of the heat-conductive path to the inside of the chamber to decrease the evaporation rate.

40. A portable liquid oxygen system for delivering gaseous oxygen to a user, the system comprising:

a container sufficiently insulated from the thermal energy of the ambient to hold oxygen in both the liquid phase and the gas phase inside the container;

a delivery system having an inlet for receiving the oxygen in the gas phase from the container, an outlet for connecting to the user to deliver the gaseous oxygen, and a conserver connected between the inlet and the outlet and operable in response to inhalation to deliver the gas to the user; and a thermo-pneumatic regulator secured to the container to vary the amount of thermal energy transferred to the container in response to variations in the pressure of the gaseous oxygen in the container.

41. The system of claim 40, wherein the container includes an inner wall defining a volume, the inlet of the delivery system located relative to the volume of the container to reduce unintended loss of the liquid phase from the container irrespective of how the user may orient the liquid oxygen system during use thereof.

42. The system of claim 40, wherein the regulator comprises a heat-conductive, elongated member having a first portion located in the container and exposed to the temperature therein and a second portion connected to the first portion and exposed to the ambient temperature.

43. The system of claim 42, wherein the elongated member includes an inner surface exposed to the pressure of the container and mounted to move in a first direction when the pressure exceeds an upper threshold, the regulator adapted to transfer less thermal energy to the container in response to the movement of the elongated member in the first direction.

44. The system of claim 43, wherein the regulator further includes a biasing mechanism to move the inner surface in a second direction when the pressure falls below a lower threshold, the regulator adapted to transfer more thermal energy to the container in response to movement of the elongated member in the second direction.

45. A method of charging a liquid oxygen system, comprising the steps of:

providing an insulated container with a vent for discharging excess oxygen and a passage in communication with the vent, the passage having an opening at a location spaced from the inner wall of the container;

initiating the filling of the container with oxygen from a supply of liquid oxygen under pressure by connecting the container to the supply;

continuing the filling process to fill the volume available in the container only partially with liquid oxygen, the filling process continuing until the volume of the liquid oxygen in the container reaches a level high enough so that the liquid oxygen enters the opening of the passage and exits the vent in a fashion discernable to the user charging the system; and disconnecting the container from the supply once the liquid oxygen is discerned to be exiting from the vent, whereby the container is charged with the partial amount of the liquid oxygen resulting from the filling process;

wherein the opening is substantially in the middle of the volume defined by the insulated container, and further comprising the step of continuing the filling process until the volume of the container is about 50% filled with the liquid oxygen.

46. A method of charging a portable liquid oxygen system, comprising the steps of:

providing an insulated container with a vent for discharging excess oxygen and a passage in communication with the vent, the passage having an opening at a location spaced from the inner wall of the container;

initiating the filling of the container with oxygen from a supply of liquid oxygen under pressure by connecting the container to the supply;

continuing the filling process to fill the volume available in the container only partially with liquid oxygen, the filling process continuing until the volume of the liquid oxygen in the container reaches a level high enough so that the liquid oxygen enters the opening of the passage and exits the vent in a fashion discernable to the user charging the system;

disconnecting the container from the supply once the liquid oxygen is discerned to be exiting from the vent, whereby the container is charged with the partial amount of the liquid oxygen resulting from the filling process; and introducing thermal energy from the ambient into the container by means of a thermally conductive path, the path exposed on one end to the temperature of the ambient and on another end to the volume defined by the insulated container, the introduction of thermal energy being sufficient to increase the pressure within the insulated container to an operational, baseline pressure.

47. The method of claim 46, wherein the insulated container has a given evaporation rate when the system is charged, and further comprising the step of introducing thermal energy into the insulated container before the system is charged to create an evaporation rate higher than the given evaporation rate, and thereby shorten the time to charge the system.

48. A method of dispensing oxygen gas from a liquid oxygen system, comprising the steps of:

providing an insulated container with a chamber adapted to be only partly filled with oxygen in the liquid phase, thereby creating a liquid oxygen volume and a volume of oxygen gas in the chamber;

maintaining the volume of the oxygen gas at pressures above ambient;

dispensing a sustained, breathable supply of the oxygen gas to a recipient through a passage in communication with the volume of the oxygen gas;

wherein the step of dispensing the oxygen including receiving the oxygen gas through the passage irrespective of the orientation of the chamber;

introducing thermal energy into the insulated container through a heat conductive path between the ambient and the chamber, wherein the step of introducing thermal energy further includes increasing the evaporation rate in response to a decrease in the pressure of the volume of gas and decreasing the evaporation rate in response to an increase in the pressure of the volume of gas.

49. The method of claim 48, further comprising the steps of exposing more of the heat-conductive path to the inside of the chamber to increase the evaporation rate and exposing less of the heat-conductive path to the inside of the chamber to decrease the evaporation rate.

* * * * *